US009790838B2

(12) United States Patent
Yoon et al.

(10) Patent No.: US 9,790,838 B2
(45) Date of Patent: Oct. 17, 2017

(54) ENGINE COOLING SYSTEM

(71) Applicants: Hyundai Motor Company, Seoul (KR); Kia Motors Corporation, Seoul (KR)

(72) Inventors: Seok Jun Yoon, Anyang-si (KR); Joong Hyun Hwang, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 138 days.

(21) Appl. No.: 14/825,874

(22) Filed: Aug. 13, 2015

(65) Prior Publication Data

US 2016/0123216 A1 May 5, 2016

(30) Foreign Application Priority Data

Oct. 29, 2014 (KR) ..... 10-2014-0148302

(51) Int. Cl.

| | |
|---|---|
| ***F02F 1/36*** | (2006.01) |
| ***F02B 75/18*** | (2006.01) |
| ***F01P 3/02*** | (2006.01) |
| *F01P 7/14* | (2006.01) |

(52) U.S. Cl.

CPC ..... *F01P 3/02* (2013.01); *F01P 7/14* (2013.01); *F01P 2003/027* (2013.01); *F01P 2007/143* (2013.01); *F01P 2007/146* (2013.01)

(58) Field of Classification Search

CPC ..... F01P 7/14; F01P 3/02; F01P 2003/027; F01P 2007/146; F01P 2007/143

USPC ..... 123/41.28, 41.74, 41.29, 41.31, 41.72, 123/41.82 R

See application file for complete search history.

(56) References Cited

U.S. PATENT DOCUMENTS

| | | | | |
|---|---|---|---|---|
| 7,647,900 | B2 * | 1/2010 | Hayashi | F01P 3/02 123/41.72 |
| 8,474,418 | B2 * | 7/2013 | Shikida | F01P 3/02 123/41.74 |
| 8,555,825 | B2 * | 10/2013 | Lenz | F01P 3/02 123/193.3 |

(Continued)

FOREIGN PATENT DOCUMENTS

| | | | |
|---|---|---|---|
| JP | 2009-264286 | A | 11/2009 |
| KR | 10-2004-0027309 | A | 4/2004 |

(Continued)

*Primary Examiner* — Syed O Hasan

(74) *Attorney, Agent, or Firm* — Morgan, Lewis & Bockius LLP

(57) ABSTRACT

An engine cooling system for cooling a cylinder head and a cylinder block separately may include a cylinder block having cylinders arranged from a front side to a rear side of an engine with a block water jacket formed therein around the cylinders, a cylinder head fastened to a top side of the cylinder block with a head water jacket formed therein from the front side to the rear side of the engine, a water pump mounted to a front side of the cylinder block for pumping coolant to a front of the block water jacket, and a coolant control valve arranged in a rear side of the cylinder block and the cylinder head to have a first end connected to a rear end of the block water jacket and a second end connected to a rear end of the head water jacket for having the coolant supplied thereto.

13 Claims, 7 Drawing Sheets

(56) References Cited

U.S. PATENT DOCUMENTS

| | | | | |
|---|---|---|---|---|
| 2005/0217615 | A1* | 10/2005 | Matsutani | F01P 3/02<br>123/41.74 |
| 2009/0301414 | A1* | 12/2009 | Netsu | F01M 5/00<br>123/41.72 |

FOREIGN PATENT DOCUMENTS

| | | | |
|---|---|---|---|
| KR | 10-2004-0092886 | A | 11/2004 |
| KR | 10-2007-0040218 | A | 4/2007 |

* cited by examiner

ENGINE COOLING SYSTEM

CROSS-REFERENCE TO RELATED APPLICATION

The present application claims priority to Korean Patent Application No. 10-2014-0148302 filed Oct. 29, 2014, the entire contents of which is incorporated herein for all purposes by this reference.

BACKGROUND OF THE INVENTION

Field of the Invention

The present invention relates to an engine cooling system for cooling a cylinder head and a cylinder block separately, in which coolant flowing through the cylinder head is separated from coolant flowing through the cylinder block for improving cooling efficiency and reducing fuel consumption on the whole.

Description of Related Art

A technology is being introduced for separating the coolant flowing through the cylinder head from the coolant flowing through the cylinder block for maintaining a coolant temperature flowing through the cylinder block relatively high and the coolant temperature flowing through the cylinder head relatively low to improve cooling efficiency and reducing fuel consumption.

By separating the coolant flowing through the cylinder block from the coolant flowing through the cylinder head thus, two thermostats may be used or one integrated control valve may be applied. In this case, as the coolant temperature flowing through the cylinder block is maintained to be comparatively high, viscosity of lubricant may become low, and combustion efficiency may be improved.

In the meantime, as the coolant flowing through the cylinder block is separated from the coolant flowing through the cylinder head, research on a water jacket for making the coolant flow from a front side (first cylinder side) to a rear side (fourth cylinder side) in succession is also being undertaken.

Along with this, research for making the coolant flow through a narrow space between cylinder bores to efficiently control a temperature surrounding a combustion chamber is also being undertaken.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an engine cooling system for cooling a cylinder head and a cylinder block separately, having advantages of improved cooling efficiency and reduced fuel consumption.

Various aspects of the present invention are directed to providing an engine cooling system for cooling a cylinder head and a cylinder block separately, to which an improved water jacket structure is applied, for making the coolant to flow from a cylinder direction, i.e., from a front side to a rear side, while separating coolant flowing through the cylinder head from the coolant flowing through the cylinder block, the coolant to flow through a narrow space between cylinder bores.

According to various aspects of the present invention, an engine cooling system for cooling a cylinder head and a cylinder block separately may include a cylinder block having cylinders arranged from a front side to a rear side of an engine with a block water jacket formed therein around the cylinders, a cylinder head fastened to a top side of the cylinder block with a head water jacket formed therein from the front side to the rear side of the engine, a water pump mounted to a front side of the cylinder block for pumping coolant to a front of the block water jacket, and a coolant control valve arranged in a rear side of the cylinder block and the cylinder head to have a first end connected to a rear end of the block water jacket and a second end connected to a rear end of the head water jacket for having the coolant supplied thereto, in which a connection passage may be formed between a top side rear end of the block water jacket and a bottom side rear end of the head water jacket for supplying the coolant supplied to the block water jacket to the head water jacket.

The connection passage may include an exhaust side connection passage formed on an exhaust side with reference to a center portion of the cylinder block, and an intake side connection passage formed on an intake side of the cylinder block.

The exhaust side connection passage may have a larger cross-sectional area than a cross-sectional area of the intake side connection passage to have a higher coolant flow rate of the coolant flowing through the exhaust side connection passage than the coolant flow rate flowing through the intake side connection passage.

A block water jacket inlet for connecting the water pump to the block water jacket may be arranged on the intake side.

The engine cooling system may further include a jacket enlarged portion which is a front direction enlargement of the block water jacket formed for having the coolant supplied thereto from the water pump and supplying the coolant to the head water jacket.

The block water jacket may have a block insert inserted in, and arranged on, a lower side of the block water jacket with a shape for directing the coolant to an upper side of the block water jacket.

The engine cooling system may further include a block cross drill hole formed in the block water jacket between cylinder bores for connecting the block water jacket from the intake side to the exhaust side.

The block cross drill hole may be formed by drilling.

The block cross drill hole may be connected with the block water jacket at at least two positions in the exhaust side, and the block cross drill hole may be connected with the block water jacket at at least one position in the intake side.

The engine cooling system may further include a block packing of a predetermined length of a pipe shape inserted in each of a front side and a rear side of the block water jacket by a pressure from a top side to a lower side of the block water jacket to a predetermined distance for making the coolant flow through the block cross drill hole.

The engine cooling system may further include a gasket arranged between the cylinder block and the cylinder head, and a block water jacket outlet formed in a top side of the rear side of the block water jacket for moving the coolant upward.

The gasket may include at least two holes formed respectively matched to the exhaust side connection passage and the intake side connection passage and at least one hole formed matched to the block water jacket outlet.

The block packing of a cylindrical pipe structure may be formed of an elastic material for inserting between the block water jackets with a pressure to deform elastically.

The block packing may be formed of rubber.

The block packing may block a portion of an upper side of the block water jacket.

According to the present invention for achieving the object, a portion of the coolant supplied to a front of the block water jacket moves upward and is supplied to the head water jacket, and the rest of the coolant flows to a rear side enabling the head water jacket to have a structure in which the coolant flows from the front side to the rear side.

The block water jacket enlarged portion formed in front of the block water jacket to supply the coolant to a head side enables the coolant to easily flow.

The block cross drill hole formed between bores of the block water jacket from the intake side to the exhaust side and the use of the packing member and the insert member enables effective flow of the coolant through the block cross drill hole.

It is understood that the term "vehicle" or "vehicular" or other similar teems as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
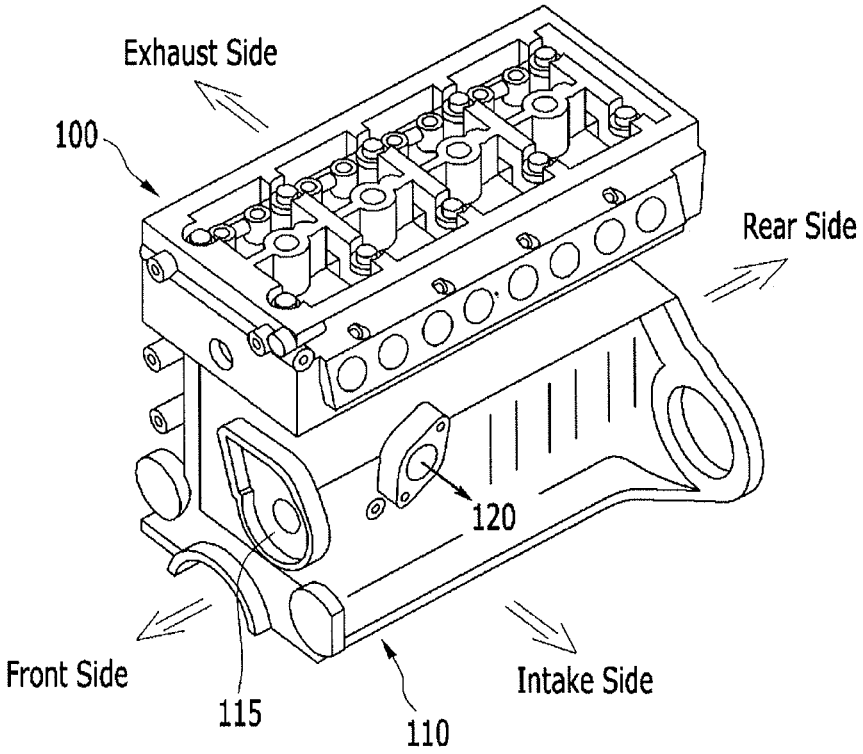
FIG. 1 illustrates a partial perspective view of an engine for cooling a cylinder head and a cylinder block separately according to the present invention.

FIG. 1 illustrates a partial perspective view of an engine for cooling a cylinder head and a cylinder block separately in accordance with various embodiments of the present invention.

Referring to FIG. 1, the engine includes a cylinder head 100 and a cylinder block 110, in which the cylinder head 100 is mounted on the cylinder block 110, a mounting portion 115 is formed on a front side of the cylinder block 110 for mounting a water pump 400 thereto, and a coolant outlet is formed on an intake side of the cylinder block 110 for connecting to an oil cooler 120.

Figure 2:
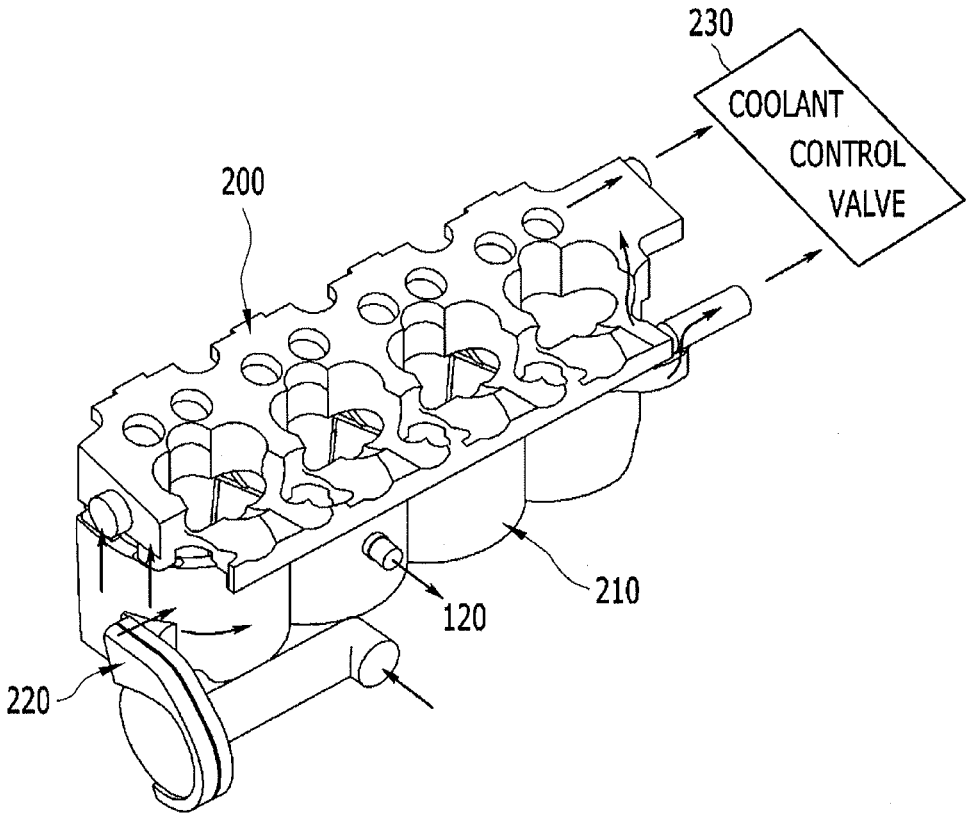
FIG. 2 illustrates a perspective view of a head water jacket and a block water jacket in an engine for cooling a cylinder head and a cylinder block separately according to the present invention.

FIG. 2 illustrates a perspective view of a head water jacket 200 and a block water jacket 210 in an engine for cooling a cylinder head and a cylinder block separately in accordance with various embodiments of the present invention.

The cylinder block 110 has four cylinders formed at predetermined intervals from a front side to a rear side, and a block water jacket 210 formed to surround circumferences of the cylinders.

A head water jacket 200 matching the cylinder head 100 is formed on the block water jacket 210. A coolant pumped by the water pump 400 is supplied to a front of the block water jacket 210 through a pump water jacket 220.

A portion of the coolant supplied to the front of the block water jacket 210 is moved upward so as to be supplied to a front of the head water jacket 200, and the rest of the coolant moves from the block water jacket 210 to a rear side of the block water jacket 210 to cool the cylinder block 110 and is discharged to one side of a coolant control valve 230.

The coolant supplied to the head water jacket 200 moves from the front side to the rear side to cool the cylinder head 100 and is discharged to the other side of the coolant control valve 230.

Figure 3:
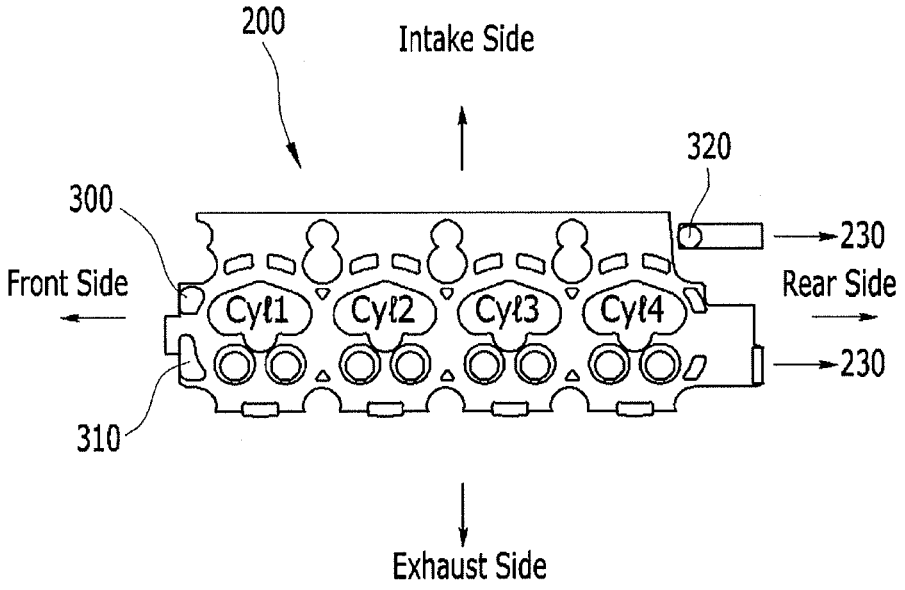
FIG. 3 illustrates a bottom view showing a bottom side of a cylinder head in an engine for cooling a cylinder head and a cylinder block separately according to the present invention.

FIG. 3 illustrates a bottom view showing a bottom side of a cylinder head in an engine for cooling a cylinder head and a cylinder block separately in accordance with various embodiments of the present invention.

Referring to FIG. 3, in a bottom side of a front side of the cylinder head 100, there is an exhaust side connection passage 310 and an intake side connection passage 300 formed therein.

The exhaust side connection passage 310 is a passage for having the coolant supplied thereto from the block water jacket 210, and the intake side connection passage 300 is a passage for having the coolant supplied thereto from the block water jacket 210. The intake side connection passage 300 is formed in the intake side of the cylinder head 100, and the exhaust side connection passage 310 is formed in the exhaust side of the cylinder head 100.

In various embodiments of the present invention, the exhaust side connection passage 310 has a larger area than that of the intake side connection passage 300, making a flow rate of the coolant passing through the exhaust side connection passage 310 higher than the flow rate of the coolant flowing through the intake side connection passage 300.

According to this, the cooling efficiency at the exhaust side of the cylinder head 100 may be improved. Along with this, as a head water jacket outlet 700 is formed on the exhaust side of the head water jacket 200, the cooling efficiency of the cylinder head 100 on the exhaust side may be improved on the whole.

Referring to FIG. 3 again, a gasket interposed between the cylinder head 100 and the cylinder block 110 has a hole formed to match the exhaust side connection passage 310, a hole formed to match the intake side connection passage 300, and a hole formed to match a block water jacket outlet 320 rising upward from the block water jacket 210. Therefore, the gasket has three coolant holes formed therein.

Figure 4:
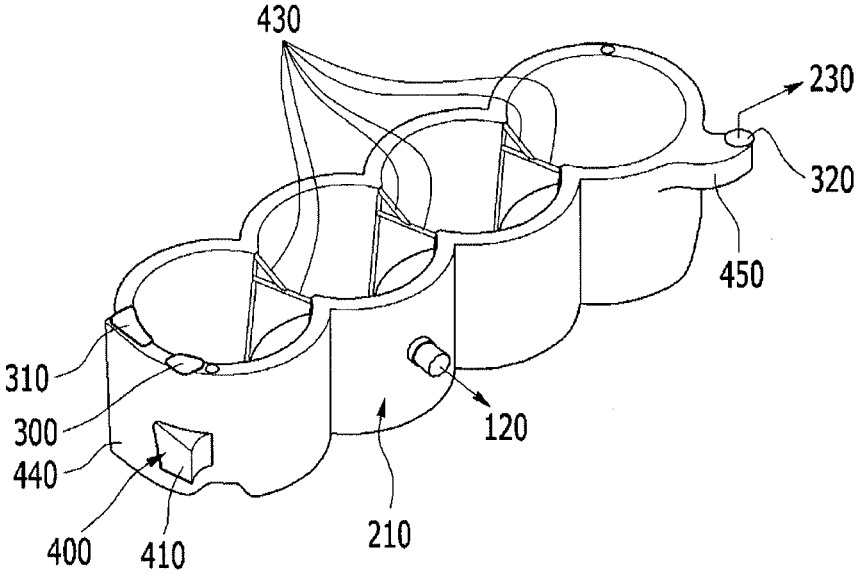
FIG. 4 illustrates a perspective view showing a block water jacket in an engine for cooling a cylinder head and a cylinder block separately according to the present invention.

FIG. 4 illustrates a perspective view showing a block water jacket in an engine for cooling a cylinder head and a cylinder block separately in accordance with various embodiments of the present invention.

Referring to FIG. 4, a block water jacket enlarged portion 440 is formed on a front side of the block water jacket 210, and the block water jacket enlarged portion 440 is connected to a block water jacket inlet 410, the exhaust side connection passage 310, and the intake side connection passage 300.

Formed on a rear side of the block water jacket 210, there is a protruded portion 450 formed on an intake side, with the block water jacket outlet 320 formed to face upward in an end portion of the protruded portion 450.

Along with this, there is a block cross drill hole 430 formed between the cylinder bores in the block water jacket 210. The coolant flows through the block cross drill hole 430 for cooling between cylinders in the cylinder block 110. The block cross drill holes 430 are formed in an upper side which is close to a combustion chamber.

Also, the block cross drill hole 430 is connected with the block water jacket 210 at least two positions in an exhaust side, and the block cross drill hole 430 is connected with the block water jacket 210 one position in an intake side. For example, referring to FIG. 4, the block cross drill holes 430 and block water jacket 210 positioned in an exhaust side meet in two places, and the block cross drill holes 430 and block water jacket 210 positioned in an intake side meet in an one places. Therefore, the block water jacket 210 positioned in the exhaust side could be cooled rapidly.

Figure 5:
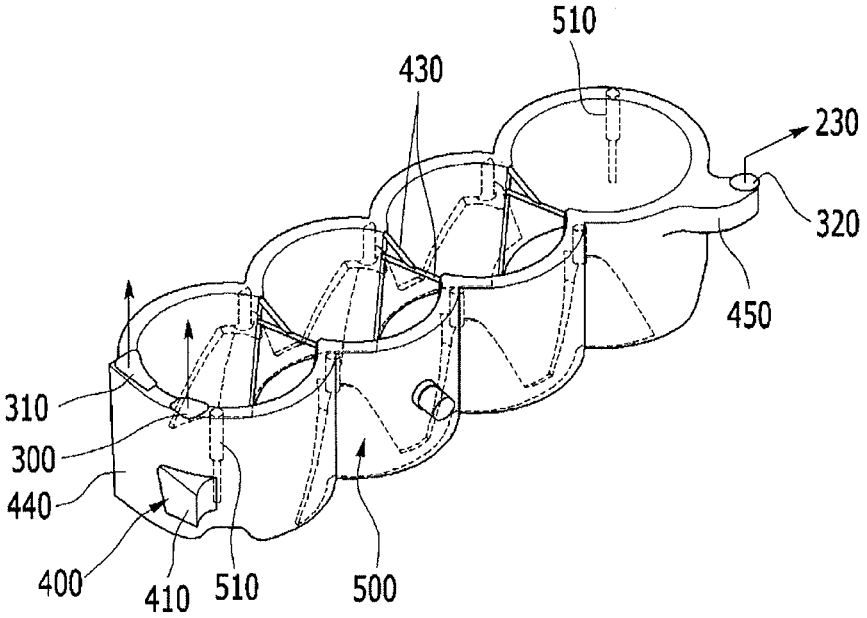
FIG. 5 illustrates a perspective view showing an inside of a block water jacket in an engine for cooling a cylinder head and a cylinder block separately according to the present invention.

FIG. 5 illustrates a perspective view showing an inside of a block water jacket in an engine for cooling a cylinder head and a cylinder block separately in accordance with various embodiments of the present invention.

Referring to FIG. 5, the block water jacket 210 has a packing member 510 and an insert member 500 arranged therein.

The insert member 500 is arranged on a lower side of the block water jacket 210 to have a sloped surface for enabling the coolant to move from a lower side to an upper side.

Along with this, the packing member 510 made of thin pipe shaped rubber is mounted to be pressed from a top side to a lower side of the block water jacket 210.

The packing member 510 controls a flow direction of the coolant flowing through an inside of the block water jacket 210 for making the coolant flow through the block cross drill holes 430.

In various embodiments of the present invention, the packing member 510 is inserted a predetermined distance from the top side of the block water jacket 210, with a packing member 510 provided to each of the front side and the rear side of the block water jacket 210.

Each packing member 510 is inserted with a downward pressure to about 67% of an entire length 100% of the block water jacket 210 from the top side to a bottom side thereof.

That is, each packing member 510 is arranged at a 67% region of the upper side for controlling a coolant flow, and the coolant flow at a 33% region of the lower side is comparably free because each packing member 510 is not inserted therein.

In various embodiments of the present invention, the packing member 510 arranged on the front side is arranged on the intake side, and the packing member 510 arranged on the rear side is arranged on the exhaust side.

Figure 6:
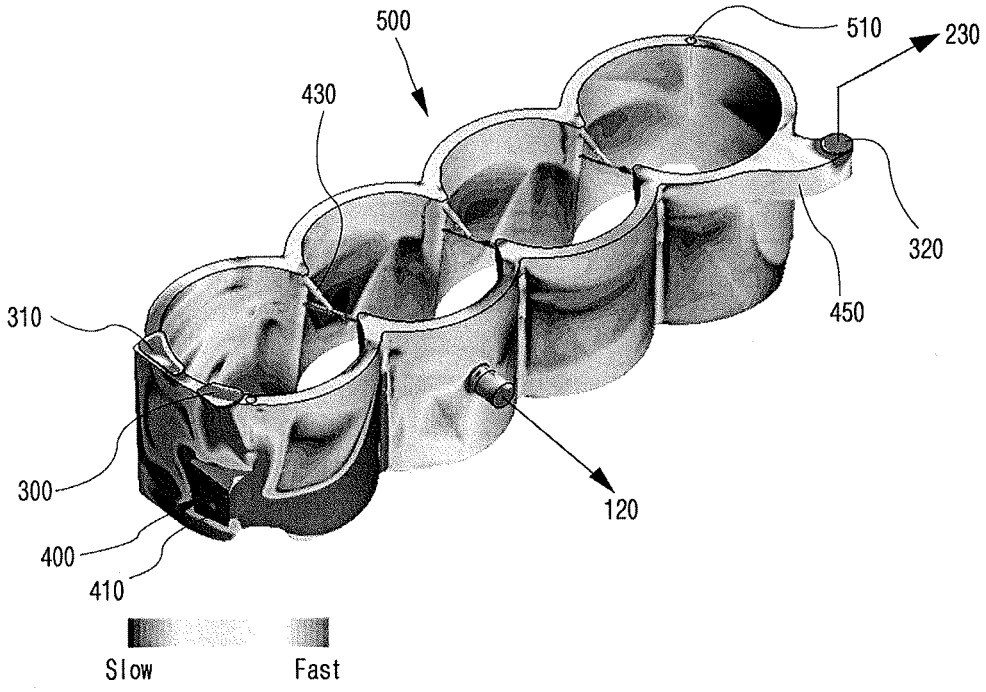
FIG. 6 illustrates a perspective view showing a coolant flow in a block water jacket in an engine for cooling a cylinder head and a cylinder block separately according to the present invention.

FIG. 6 illustrates a perspective view showing a coolant flow in a block water jacket in an engine for cooling a cylinder head and a cylinder block separately in accordance with various embodiments of the present invention.

Referring to FIG. 6, a flow through the exhaust side connection passage 310 is a fast coolant flow, and a flow through the intake side connection passage 300 is a slow coolant flow.

It may be noticed that the coolant is supplied through the block water jacket inlet 410, the coolant moves toward the head water jacket 200 rapidly through the intake side connection passage 300 and the exhaust side connection passage 310, and the coolant moves from the front side to the rear side, and the coolant is also rapidly discharged through the block water jacket outlet 320.

It may be noticed that the packing member 510 blocks the coolant flow to make the coolant flow to be slow or blocked, and to make the coolant flow to move to the lower side where the packing member 510 is not arranged. Along with this, the insert member 500 controls the coolant to not flow downward, but to flow uniformly on the whole.

Figure 7:
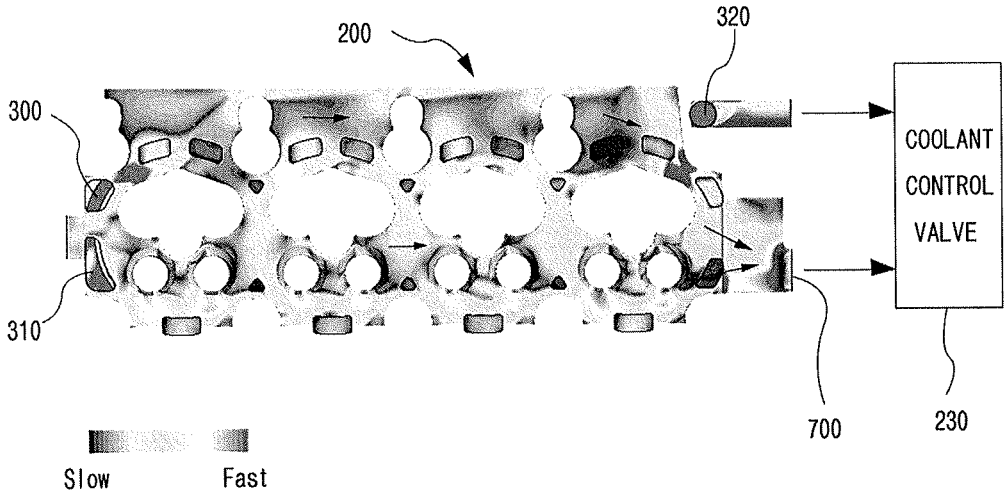
FIG. 7 illustrates a plan view showing a coolant flow in a head water jacket in an engine for cooling a cylinder head and a cylinder block separately according to the present invention.

FIG. 7 illustrates a plan view showing a coolant flow in a head water jacket in an engine for cooling a cylinder head and a cylinder block separately in accordance with various embodiments of the present invention.

Referring to FIG. 7, a flow through the exhaust side connection passage 310 is a fast coolant flow, and a flow through the intake side connection passage 300 is a slow coolant flow. It may be noticed that the coolant is supplied rapidly through the intake side connection passage 300 and the exhaust side connection passage 310, the coolant flows from the front side to the rear side on the whole, and the coolant is rapidly discharged through the block water jacket outlet 320 and the head water jacket outlet 700 and is supplied to the coolant control valve 230.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings.

The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine cooling system for cooling a cylinder head and a cylinder block separately, the engine cooling system comprising:

a cylinder block having cylinders arranged from a front side to a rear side of an engine with a block water jacket formed therein around the cylinders;

a cylinder head fastened to a top side of the cylinder block with a head water jacket formed therein from the front side to the rear side of the engine;

a water pump mounted to a front side of the cylinder block for pumping coolant to a front of the block water jacket;

a coolant control valve arranged in a rear side of the cylinder block and the cylinder head to have a first end connected to a rear end of the block water jacket and a second end connected to a rear end of the head water jacket for having the coolant supplied thereto;

a block cross drill hole formed in the block water jacket between cylinder bores for connecting the block water jacket from the intake side to the exhaust side; and a block packing of a predetermined length of a pipe shape inserted in each of a front side and a rear side of the block water jacket by a pressure from a top side to a lower side of the block water jacket to a predetermined distance for making the coolant flow through the block cross drill hole, wherein a connection passage is formed between a top side rear end of the block water jacket and a bottom side rear end of the head water jacket for supplying the coolant supplied to the block water jacket to the head water jacket.

2. The engine cooling system of claim 1, wherein the block water jacket has a block insert inserted in, and arranged on, a lower side of the block water jacket with a shape for directing the coolant to an upper side of the block water jacket.

3. The engine cooling system of claim 1, wherein the block cross drill hole is formed by drilling.

4. The engine cooling system of claim 1, wherein the block packing of a cylindrical pipe structure is formed of an elastic material for inserting between the block water jackets with a pressure to deform elastically.

5. The engine cooling system of claim 1, wherein the block packing blocks a portion of an upper side of the block water jacket.

6. The engine cooling system of claim 1, wherein the connection passage comprises:

an exhaust side connection passage formed on an exhaust side with reference to a center portion of the cylinder block; and an intake side connection passage formed on an intake side of the cylinder block.

7. The engine cooling system of claim 6, wherein the exhaust side connection passage has a larger cross-sectional area than a cross-sectional area of the intake side connection passage to have a higher coolant flow rate of the coolant flowing through the exhaust side connection passage than the coolant flow rate flowing through the intake side connection passage.

8. The engine cooling system of claim 6, wherein a block water jacket inlet for connecting the water pump to the block water jacket is arranged on the intake side.

9. The engine cooling system of claim 6, further comprising a jacket enlarged portion which is a front direction enlargement of the block water jacket formed for having the coolant supplied thereto from the water pump and supplying the coolant to the head water jacket.

10. The engine cooling system of claim 6, further comprising:

a gasket arranged between the cylinder block and the cylinder head; and a block water jacket outlet formed in a top side of the rear side of the block water jacket for moving the coolant upward.

11. The engine cooling system of claim 3, wherein the block cross drill hole is connected with the block water jacket by at least two positions in the exhaust side, and the block cross drill hole is connected with the block water jacket by at least one position in the intake side.

12. The engine cooling system of claim 10, wherein the gasket includes at least two holes formed respectively matched to the exhaust side connection passage and the intake side connection passage and at least one hole formed matched to the block water jacket outlet.

13. The engine cooling system of claim 4, wherein the block packing is formed of rubber.

* * * * *